US010140966B1

(12) United States Patent
Edwards

(10) Patent No.: US 10,140,966 B1
(45) Date of Patent: Nov. 27, 2018

(54) LOCATION-AWARE MUSICAL INSTRUMENT

(71) Applicant: Ryan Laurence Edwards, Watertown, MA (US)

(72) Inventor: Ryan Laurence Edwards, Watertown, MA (US)

( * ) Notice: Subject to any disclaimer, the term of this patent is extended or adjusted under 35 U.S.C. 154(b) by 0 days.

(21) Appl. No.: 15/838,899

(22) Filed: Dec. 12, 2017

(51) Int. Cl.
*G10H 1/00* (2006.01)
*G10H 7/00* (2006.01)

(52) U.S. Cl.
CPC ..... *G10H 1/0083* (2013.01); *G10H 1/0066* (2013.01); *G10H 7/002* (2013.01); *G10H 2220/111* (2013.01)

(58) Field of Classification Search
CPC ..... G06T 1/00; G06T 2200/24; G10H 1/00; G10H 7/00; G10H 2210/066; G10H 2220/005; G10H 2240/141
See application file for complete search history.

(56) References Cited

U.S. PATENT DOCUMENTS 4,801,141 A 1/1989 Rumsey
4,836,075 A 6/1989 Armstrong
5,541,358 A 7/1996 Wheaton et al.
6,990,453 B2 * 1/2006 Wang ..... G06F 17/30743 704/270
7,750,224 B1 * 7/2010 Rav-Niv ..... G09B 15/009 84/483.1
8,539,368 B2 * 9/2013 Nam ..... G06F 3/011 463/36
8,686,272 B2 * 4/2014 Bonet ..... G06F 17/30743 700/94
2006/0075885 A1 * 4/2006 Bailey ..... H04S 3/00 84/630
2011/0167988 A1 * 7/2011 Berkovitz ..... G09B 15/02 84/483.2
2011/0191674 A1 8/2011 Rawley et al.
2013/0305905 A1 * 11/2013 Barkley ..... G10H 1/0025 84/609
2016/0203805 A1 * 7/2016 Strachan ..... G10G 1/00 84/609

FOREIGN PATENT DOCUMENTS

EP 0264782 4/1988

OTHER PUBLICATIONS

Chafe, "Case Studies of Physical Models in Music Composition", In Proc. 18th Intl. Cong. Acoustics (ICA), (Apr. 2004) (5 pages).
Hays + Ryan Holladay, Webpage, Retrieved from: https://www.hrholladay.com/, Printed Mar. 7, 2018.
Ballston, Hays + Ryan Holladay, "Site:WA+FC(Ballston)," http://www.ballstonbid.com/art-projects/site-wa-fc-ballston, Copyright 2018.
Pozyx Accurate Positioning Documentation, Webpage, Retrieved from: https://www.pozyx.io/Documentation, Printed Mar. 7, 2018.
Hays + Ryan Holladay Location Aware Music, Webpage, Retrieved from: http://www.hrholladay.com/location-aware-music/, Printed Mar. 7, 2018.

* cited by examiner

*Primary Examiner* — Marlon Fletcher
(74) *Attorney, Agent, or Firm* — DLA Piper LLP US

(57) ABSTRACT

A system and method for receiving, from each of a plurality of moveable nodes, the position of the moveable node within a coordinate space, generating a graph of the moveable nodes based on the received positions, generating an audio-visual composition based on a sweep of the graph over time, and outputting the audio-visual composition.

12 Claims, 6 Drawing Sheets

LOCATION-AWARE MUSICAL INSTRUMENT

BACKGROUND

Conventional musical instruments are provided as either stationary objects or portable devices carried by a user. A user may play a conventional instrument, for example, by pressing keys, plucking strings, etc. Musical instruments have well-established utility in entertainment and artistic pursuits. There is a need for a new type of musical instruments that can provide enhanced entertainment opportunities for individuals and groups of people.

SUMMARY

Described herein are embodiments of systems and methods providing a location-aware musical instrument. In some embodiments, individual persons or groups of people can interact with the instrument by physically moving objects (or "nodes") within a space to change timing, pitch, and/or texture of music generated by the instrument. In certain embodiments, the movable nodes produce visible light (or provide some other sensory feedback) in synchronization with the generated music, resulting in an immersive, entertainment experience for the users.

According to one aspect of the disclosure, a method comprises: receiving, from each of a plurality of moveable nodes, the position of the moveable node within a coordinate space; generating a graph of the moveable nodes based on the received positions; generating an audio-visual composition based on a sweep of the graph over time; and outputting the audio-visual composition.

In some embodiments, generating an audio-visual composition comprises generating a digital music composition. In certain embodiments, generating an audio-visual composition comprises generating light at each of the moveable nodes, wherein the generated light is synchronized to the digital music composition. In particular embodiments, generating an audio-visual composition based on a sweep of the graph over time comprises: sweeping a line across the graph; detecting when the line intersects with points on the graph corresponding to the moveable nodes; generating musical events in response to detecting the intersects. In some embodiments, generating an audio-visual composition based on a sweep of the graph over time comprises sweeping two or more lines across the graph simultaneously to generate musical events.

In particular embodiments, generating the audio-visual composition based on a sweep of the graph over time comprises dividing the coordinate space into a plurality of bins, and assigning, to each of the moveable nodes, a bin selected from the plurality of bins using a quantization process based on the received positions.

According to another aspect of the disclosure, a system comprises: a processor; at least one non-transitory computer-readable memory communicatively coupled to the processor; and processing instructions for a computer program, the processing instructions encoded in the computer-readable memory, the processing instructions, when executed by the processor, operable to perform one or more embodiments of the method disclosed herein.

BRIEF DESCRIPTION OF THE DRAWINGS

The foregoing features may be more fully understood from the following description of the drawings in which.

The drawings are not necessarily to scale, or inclusive of all elements of a system, emphasis instead generally being placed upon illustrating the concepts, structures, and techniques sought to be protected herein.

DETAILED DESCRIPTION

Figure 1:
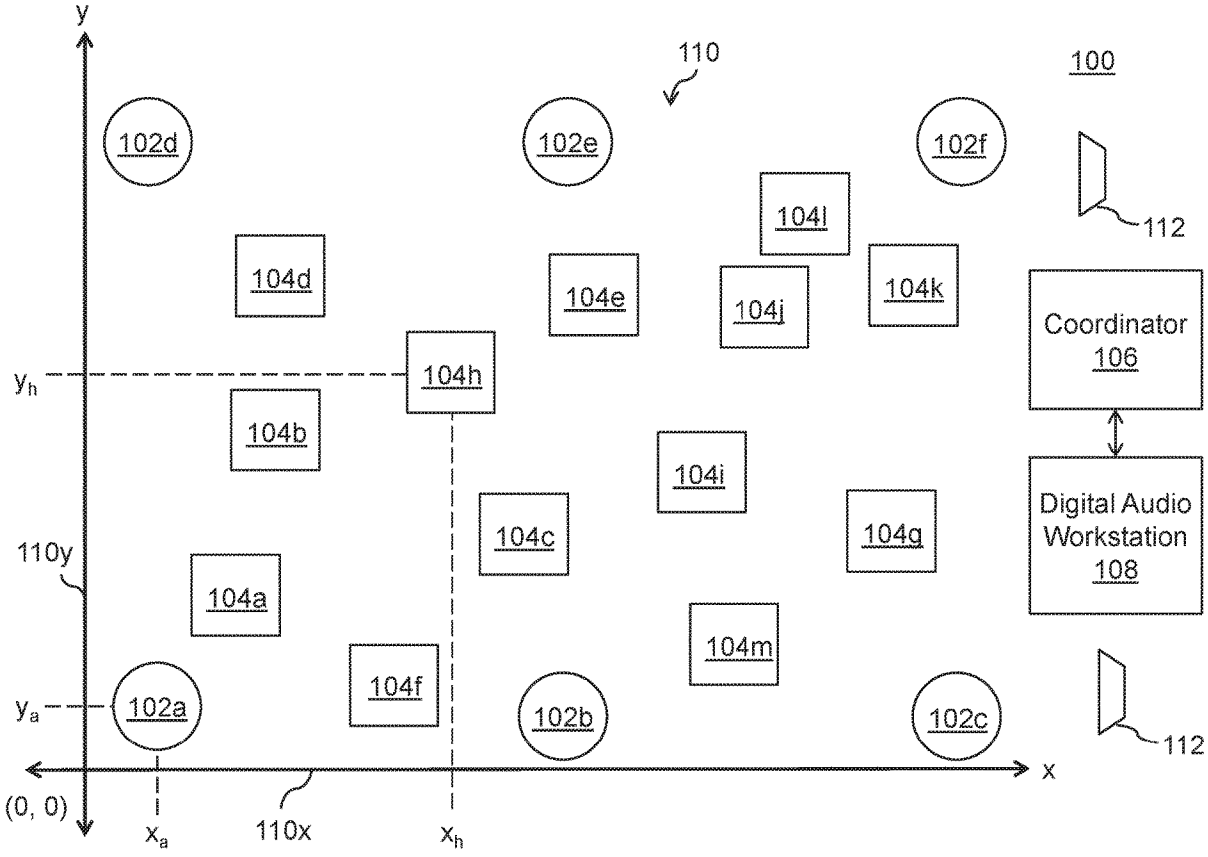
FIG. 1 is a diagram showing a system for generating a location-based audible musical composition, in accordance with an embodiment of the disclosure.

FIG. 1 shows a system 100 for generating a location-based audible musical composition, according to an embodiment of the present disclosure. The illustrative system 100 comprises one or more anchors (102 generally), a plurality of moveable nodes (104 generally), a coordinator 106, a digital audio workstation (DAW) 108, and one or more loudspeakers 112. In the embodiment shown, the system 100 includes six (6) anchors 102*a*-102*f* and thirteen (13) movable nodes 104*a*-104*m*. In other embodiments, the number of anchors 102 and movable nodes 104 may vary. In certain embodiments, the system 100 includes at least four (4) anchors 102.

The anchors 102 and movable nodes 104 each have a position within a two-dimensional (2D) coordinate system defined by x-axis 110*x* and y-axis 110*y*, as shown. In certain embodiments, the coordinate system (referred to herein as the "active area" 110) may correspond to a floor surface within a building, a ground surface outdoors, or another substantially horizontal planar surface. The positions of the anchors 102 and moveable nodes 104 within the active area 110 may be defined as (x, y) coordinate pairs. For example, anchor 102*a* may have position ($x_a$, $y_a$) and moveable node 104*h* may have position ($x_h$, $y_h$), as shown. The position of a given anchor/node within the active area 110 may be defined relative to some fixed point on the body of the anchor/node.

In the example of FIG. 1, the active area 110 is defined as a 2D space. In other embodiments, the active area may be defined as a three-dimensional (3D) space (e.g., using x-, y-, and z-axes), and the positions of the anchors 102 and movable nodes 104 may be specified as (x, y, z) values defined within this 3D coordinate system.

The anchors 102 have known, fixed positions within the active area 110, whereas positions of the moveable nodes 104 can change. For example, the anchors 102 may be fixedly attached to mounts, while the moveable nodes 104 may have physical characteristics that allow persons to easily relocate the nodes within the active area 110.

In some embodiments, the positions of the anchors 102 may be determined automatically using a calibration process. In other embodiments, they may be programmed or otherwise configured with the anchors. In certain embodiments, the anchors 102 may be positioned along, or near, the perimeter of the active area 110. Each anchor 102 may broadcast (or "push") its known position over a wireless channel such that it can be received by movable nodes 104 within the active space 110. In some embodiments, the anchor positions are transmitted over an ultra-wideband (UWB) communication channel provided between the anchors 102 and movable nodes 104.

A movable node 104 can use information transmitted from a plurality of anchors 102 (e.g., two anchors, three anchors, or a greater number of anchors) to calculate its own position within the active area 110. In many embodiments, a movable node 104 uses trilateration of signals based on Time Difference of Arrival (TDOA) to determine its position. In particular, each anchor 102 may broadcast a wireless signal that encodes timing information along with the anchor's position. A moveable node 104 can decode signals received from at least three distinct anchors 102 to determine the node's position in two dimensions by triangulating the signals using TDOA. In some embodiments, a node 104 can determine its position in three dimensions using signals received from at least four distinct anchors 102. Using the aforementioned techniques, a moveable node 104 can calculate its position a continuous or periodic basis.

The moveable nodes 104 can transmit (or "report") their calculated positions to the coordinator 106 over, for example, the UWB communication channel. The nodes 104 may also communicate with the coordinator 106 via Wi-Fi. For example, a wireless local area network (WLAN) may be formed among the coordinator 106 and moveable nodes 104. In certain embodiments, a moveable node 104 may include components shown in FIG. 2 and described below in conjunction therewith.

The coordinator 106 can receive the positions of the moveable nodes 104 and plot the positions on a 2D (or 3D) graph. The coordinator 106 may perform a sweep of the graph over time and, based on the positions of the nodes 104, may generate digital music events that are sent to the DAW 108. In turn, the DAW generates digital music composition which can be converted to audible sound output. Thus, the coordinator 106 and the DAW 108 cooperate to generate a location-based audible music composition. In many embodiments, the generated music events are Musical Instrument Digital Interface (MIDI) events, which are sometimes referred to as "bangs" or "triggers." The DAW 108 receives the MIDI event data from the coordinator 106 and may use various control mechanisms to vary the timing, pitch, and/or texture of music based on the MIDI event data.

The audible sound output may be output via speakers 112 such that it can be heard by persons within and about the active area 110. In some embodiments, the speakers 112 are coupled to the DAW 108. In other embodiments, the speakers 112 may be coupled to the coordinator 106. Although two speakers 112 are shown in FIG. 1, any suitable number of speakers may be provided.

In some embodiments, the DAW 108 may be incorporated into the coordinator 106. For example, the DAW 108 may correspond to MIDI-capable software running on the coordinator computer. In particular embodiments, the coordinator 106 may be provided as a laptop computer.

The physical position of the moveable nodes 104 within the active space 110 determines the timing, pitch, or texture, etc. of discrete "musical incidents" within the generated composition. The term "musical incident" may refer to an individual musical note, to a combination of notes (i.e., a chord), or to a digital music sample. In some embodiments, moving a node 104 to a higher y-axis value may raise the pitch of a musical incident within the musical composition, whereas moving the node 104 to a higher x-axis value may cause the musical incident to occur at a later point in time within the composition. Thus, the system 100 can function as a location-aware musical instrument, where the nodes 104 can be rearranged along multiple physical axes to change the musical composition. One or more persons can interact with the system 100 to "play" the instrument by changing the physical arrangement and organization of the nodes 104 in physical space.

In some embodiments, the coordinator 106 transmits (e.g., via the WLAN) sensory feedback control information to the moveable nodes 104 based on the position of individual nodes 104 and/or the overall arrangement of nodes 104. In response, the nodes 104 may generate sensory feedback, such as sound, light, or haptic feedback. In one example, the coordinator 106 directs each node 104 to produce light, sound, or other sensory feedback at the point in time when the corresponding musical incident occurs within the audible musical composition. In this way, a person can see and hear "time" moving sequentially across the active space 110. In some embodiments, the color or duration of light produced by a node 104 may be varied based on some quantitative aspect of the digital music composition.

In certain embodiments, coordinator 106 may include components shown in FIG. 3 and described below in conjunction therewith.

Figure 2:
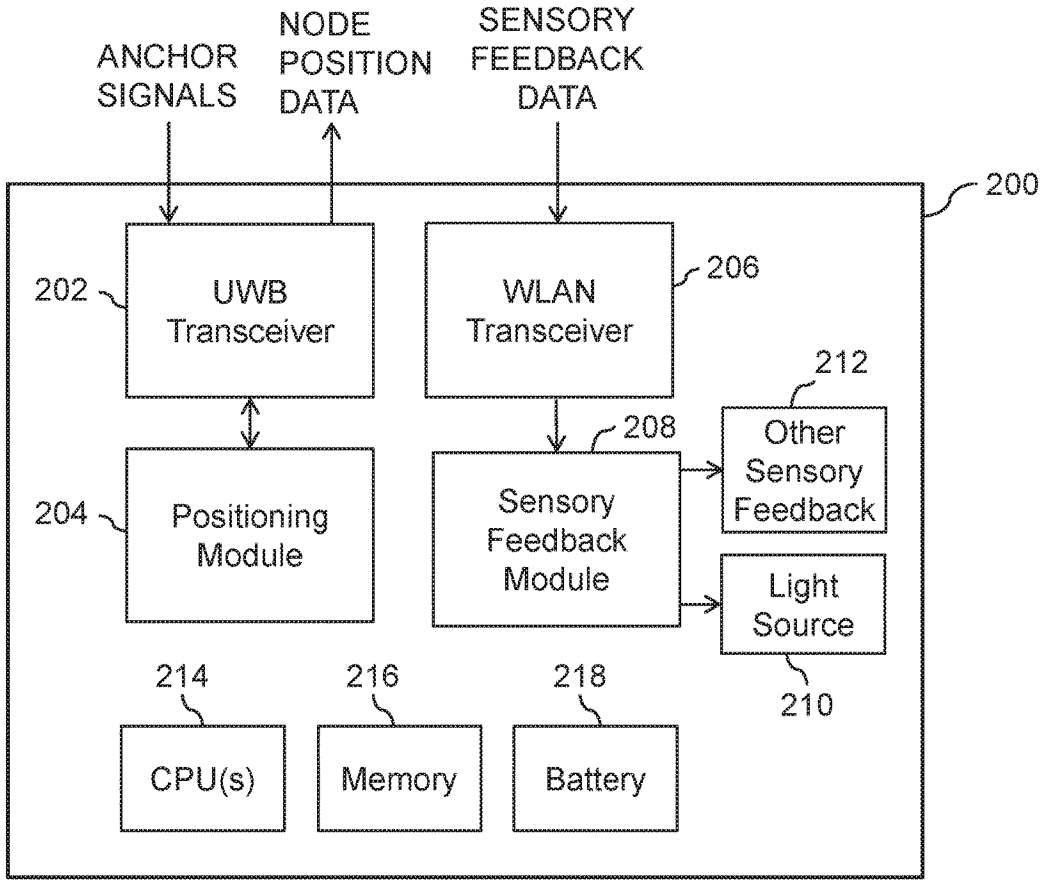
FIG. 2 is a block diagram showing a moveable node that may be used within the system of FIG. 1, in accordance with an embodiment of the disclosure.

FIG. 2 shows components that may be included within a moveable node 200, according to embodiments of the present disclosure. The illustrative moveable node 200 includes a UWB transceiver 202, a positioning module 204, and a WLAN transceiver 206, which may be coupled as shown. The moveable node 200 may also include one or more sensory feedback mechanisms, such as a light source 210, controlled by a sensory feedback module 208. The light source 210 may be provided as a string of light-emitting diodes (LEDs) in one or more colors. The sensory feedback module 206 may include hardware and/or software to control the LEDs. In another example, the sensory feedback module 208 may include hardware and/or software to produce haptic feedback or other types of sensory feedback 212. The illustrative moveable node 200 also includes a central processing unit (CPU) 214, memory 216, and a battery 218.

The UWB transceiver 202 is configured to receive signals transmitted by anchors (e.g., anchors 102 in FIG. 1). An anchor signal may include timing information along with information about the position of an anchor. The positioning module 204 is configured to determining the position of the node 200 based on trilateration of the anchor signals using on Time Difference of Arrival (TDOA). The node position information may be transmitted/reported to a coordinator (e.g., coordinator 106 in FIG. 1) via the UWB transceiver 202.

The WLAN transceiver 206 is configured for wireless networking with a coordinator (e.g., coordinator 106 in FIG. 1) and/or with other moveable nodes. In some embodiments, the WLAN transceiver 206 may be provided as a Wi-Fi router. The WLAN transceiver 206 may be used to register the node 200 with the coordinator and to receive sensory feedback information from the coordinator.

The sensory feedback module 208 controls the light source 210 and/or other sensory feedback mechanisms 112 based on the control information received from the coordinator. For example, the coordinator may communicate a LED program data (e.g., a sequence of commands such as blink, turn red, pulse blue, slow fade, etc.) to the node 202, which in turn sends this data to LED control hardware within the node 200. The LED control hardware may receive the LED program data and translate it into electronic pulses causing individual LEDs to produce light.

In some embodiments, the moveable node 200 is provided within a housing formed of plastic (e.g., high density polyethylene) or other rigid material. In particular embodiments, the housing is cube-shaped with the length of each side being approximately 17".

Figure 3:
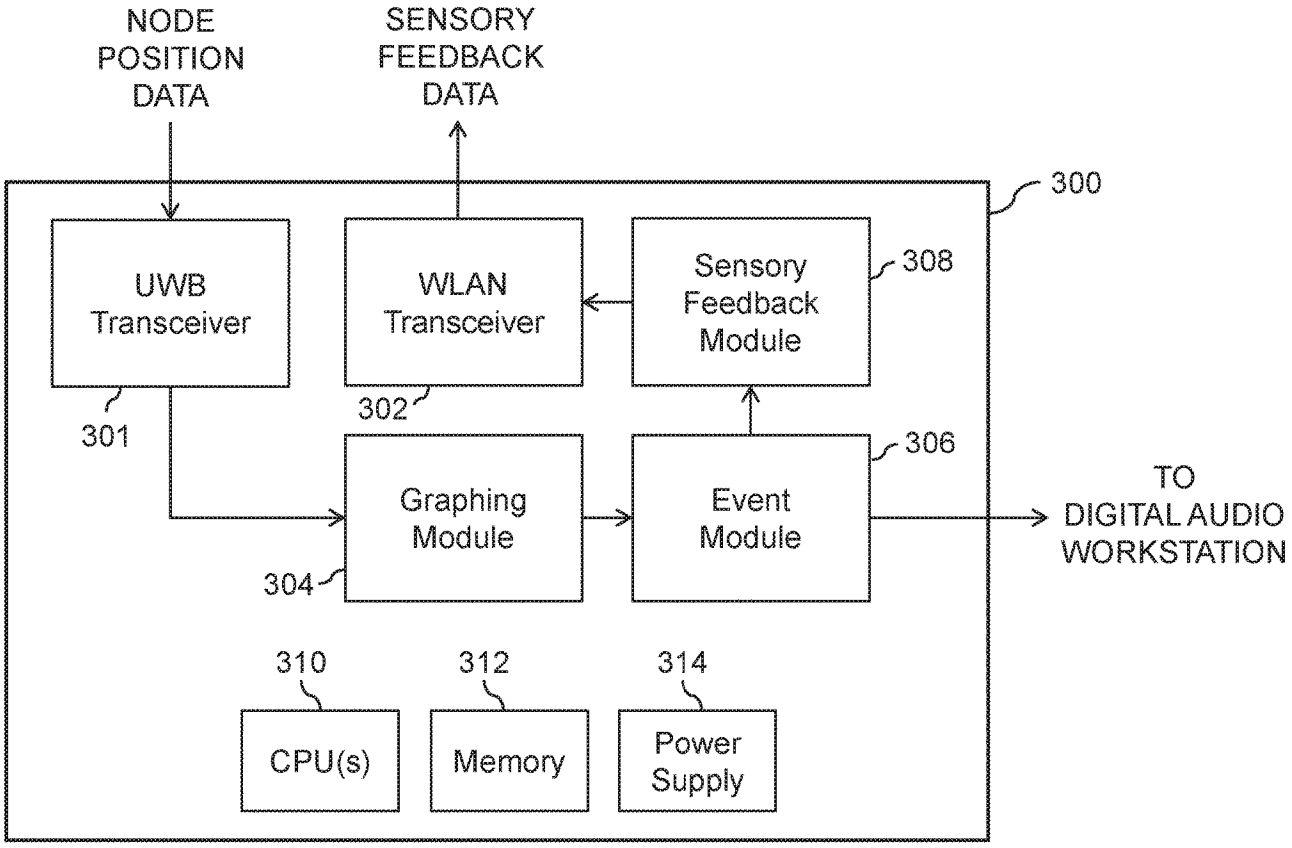
FIG. 3 is a block diagram showing a coordinator that may be used within the system of FIG. 1, in accordance with an embodiment of the disclosure.

FIG. 3 shows components that may be included within a coordinator 300, according to embodiments of the present disclosure. The illustrative coordinator 300 includes a UWB transceiver 301, a WLAN transceiver 302, a graphing module 304, an event module 306, and a sensory feedback module 308. The coordinator may also include a CPU 310, memory 312, and a power supply 314, as shown.

Figure 4:
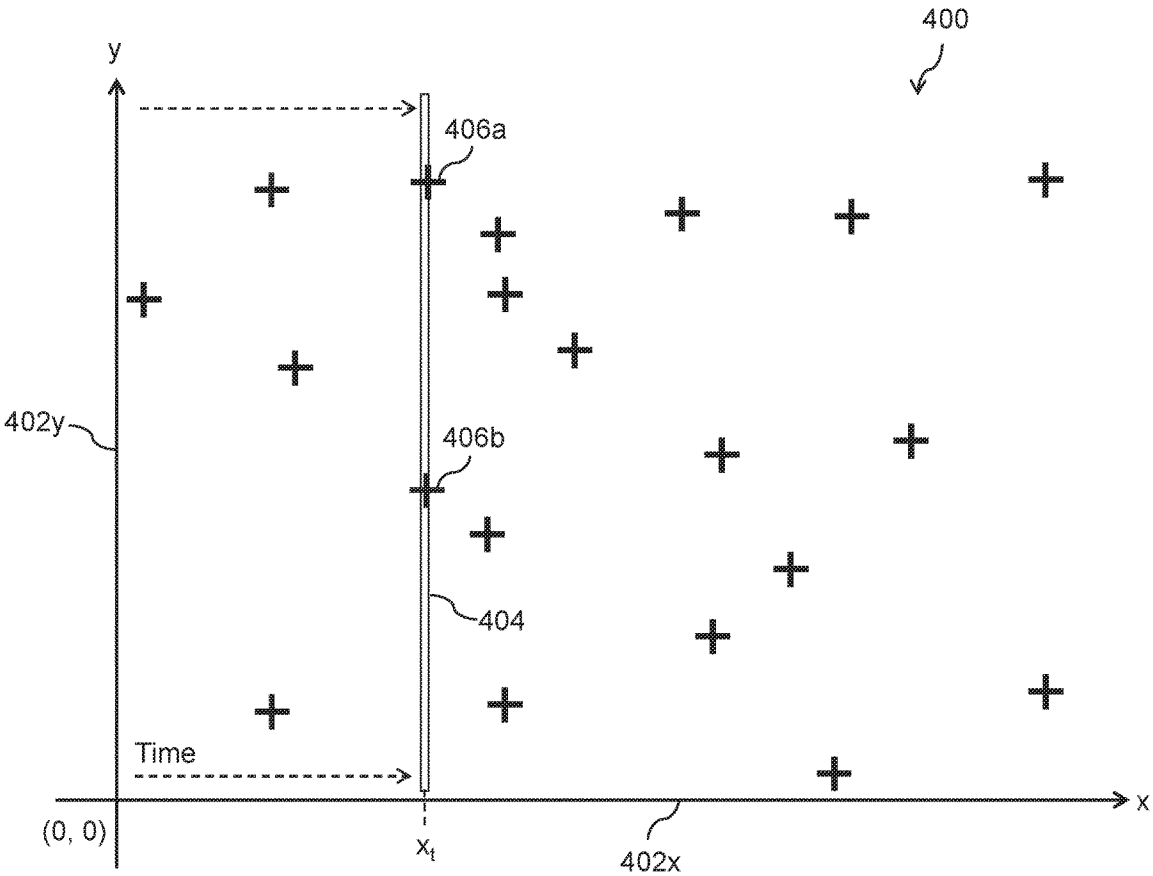
FIG. 4 is a graph showing positions of moveable nodes within a location-based musical instrument, in accordance with an embodiment of the disclosure.

The UWB transceiver 301 receives the positions of moveable nodes (e.g., nodes 104 in FIG. 1) as calculated and reported by those nodes. The graphing module 304 plots the moveable node positions to generate a 2D (or 3D) graph, an example of which is shown in FIG. 4 and described below in conjunction therewith. The event module 306 can use the generated graph to trigger music events (e.g., MIDI events or "bangs"). In some embodiments, the event module 306 performs a sweep over-time of the graph, generating music events at points in time where the sweep intersects the plotted node positions. This technique is illustrated in FIG. 4.

The generated music events may be sent to a digital audio workstation (e.g., DAW 108 in FIG. 1) to produce a note or other type of audible musical incident. In some embodiments, the music events are also sent to the sensory feedback module 308. In certain embodiments, the sensory feedback module 308 includes LED controlling software through which the music events may be routed to generate LED program data that for a particular movable node(s). The LED program data or other sensory feedback information may be transmitted to the movable node via the WLAN transceiver 302. In some embodiments, the WLAN transceiver 302 may be provided as a Wi-Fi transceiver. In certain embodiments, the WLAN transceiver 302 is also used to "see" the moveable nodes. For example, each of the moveable nodes may register with the coordinator 300 via the WLAN transceiver 302.

FIG. 4 illustrates a graph 400 of moveable node positions that may be generated by a coordinator (e.g., coordinator 106 in FIG. 1), according to embodiments of the present disclosure. The illustrative graph 400 includes an x-axis 404*x*, a y-axis 404*y*, and a plurality of moveable node positions, depicted as crosses (+) in FIG. 4 and generally denoted 406 herein. To promote clarity in the drawings, only two of the node positions 406*a* and 406*b* are labeled in FIG. 4.

In the embodiment shown, the x-axis 402*x* may represent time and the y-axis 402 may be represent pitch, texture, or some other musical quality. A line (sometimes referred to as a "transport") 404 may be swept across the graph 400 over time, i.e., from left to right starting at x=0. The sweep may stop when the transport 400 reaches some maximum position along the x-axis 402*x* (e.g., a maximum position defined by the physical size of the active area). In many embodiments, the sweep repeats (or "loops") when the transport reaches the maximum x-axis value.

As the transport 404 intersects (or "collides") with a moveable node position 406, a music event (or "bang") may be triggered. The music event may include information about pitch, texture, etc. based on the node position 406 along the y-axis 402*y*. In the example of FIG. 4, when the transport 404 is at position $x=x_t$, it may collide with node positions 406*a* and 406*b*. As a result, two music events may be generated at this point in time, a first event associated with node 406*a* and a second event associated with node 406*b*. The first music event may, for example, have a higher pitch compared to the second event based on the position of the relative position of nodes 406*a*, 406*b* along the y-axis 402*y*. Thus, moving a node to a higher y-axis value may raise the pitch of a corresponding music event, while moving the node to a higher x-axis value might cause the music event to occur later in "time" or, in the case of looping, later in the loop sequence.

Although a 2D graph is shown in the example in FIG. 4, it will be understood that the concepts and techniques sought to be protected herein could also use a 3D graph. In the case of a 3D graph, the transport line 404 could be, for example, replaced by a planar surface. In addition, the transport 404 may be "swept" along any desired axis and in any desired direction to indicate the passage of time. For example, referring to FIG. 4, the transport 404 could be swept from left-to-right, from right-to-left, from top-to-bottom, etc. In some embodiments, multiple sweeps may be conducted simultaneously. For example, two or more transports may be offset from each other traveling in the same direction. As another example, two transports may be swept in opposite directions from each other. In particular embodiments, a transport 404 may travel in different directions. For example, a transport may travel from left-to-right across a graph, and then from right-to-left, with this "ping pong" pattern repeating as desired.

Figure 5:
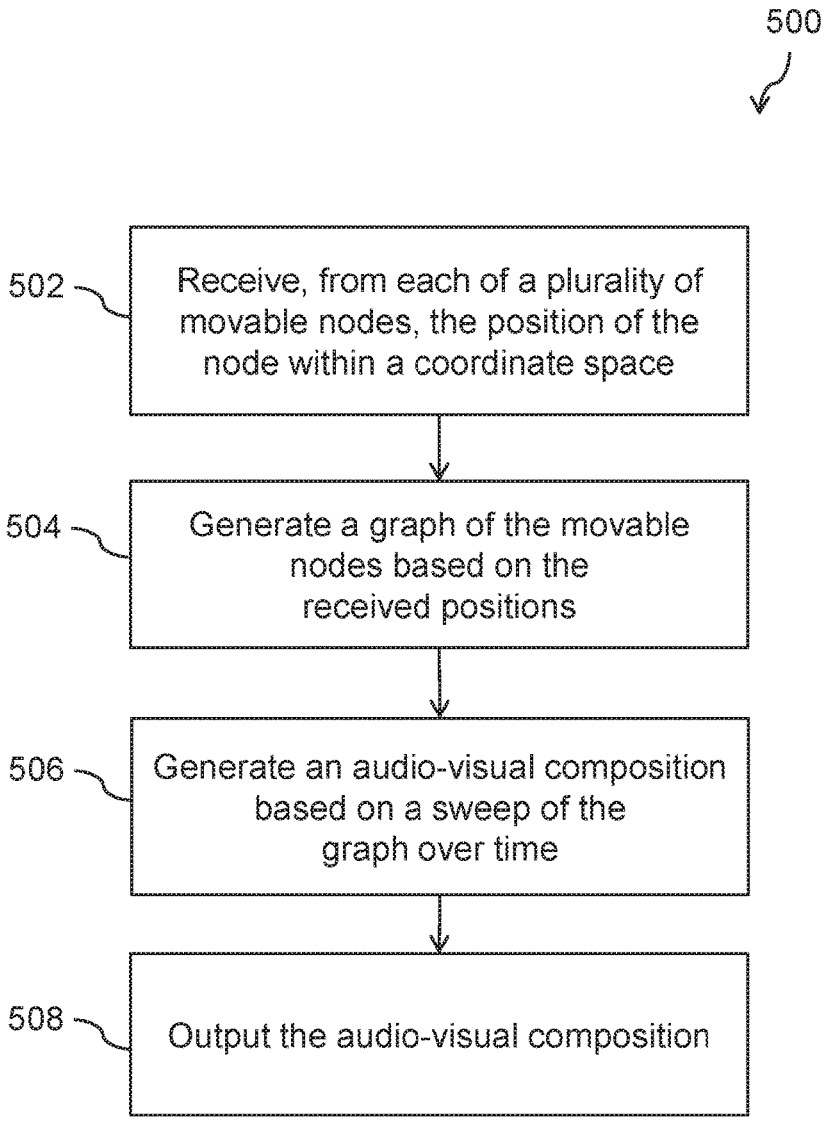
FIG. 5 is a flow diagram showing a process for generating a location-based audio-visual composition, in accordance with an embodiment of the disclosure.

FIG. 5 is a flow diagram showing illustrative processing that can be implemented within a coordinator, such as coordinator 300 shown in FIG. 3 and described above. Rectangular elements (typified by element 500 in FIG. 5), herein denoted "processing blocks," represent computer software instructions or groups of instructions. Alternatively, the processing blocks may represent steps performed by functionally equivalent circuits such as a digital signal processor (DSP) circuit or an application specific integrated circuit (ASIC). The flow diagram does not depict the syntax of any particular programming language but rather illustrate the functional information one of ordinary skill in the art requires to fabricate circuits or to generate computer software to perform the processing required of the particular apparatus. Many routine program elements, such as initialization of loops and variables and the use of temporary variables may be omitted for clarity. The particular sequence of blocks described is illustrative only and can be varied without departing from the spirit of the concepts, structures, and techniques sought to be protected herein. Thus, unless otherwise stated, the blocks described below are unordered meaning that, when possible, the functions represented by the blocks can be performed in any convenient or desirable order.

Referring to FIG. 5, a process 500 begins at block 502, where a position is received, from each of a plurality of moveable nodes, of the node within a coordinate space. At block 504, a graph of the node positions is generated. At block 506, an audio-visual composition (e.g., music and/or light) is generated based on a sweep of the graph over time. At block 508, the audio-visual composition may be output. For example, block 508 may include generating light at one or more of the nodes. As another example, block 508 may include outputting a digital music composition via speakers.

Figure 6:
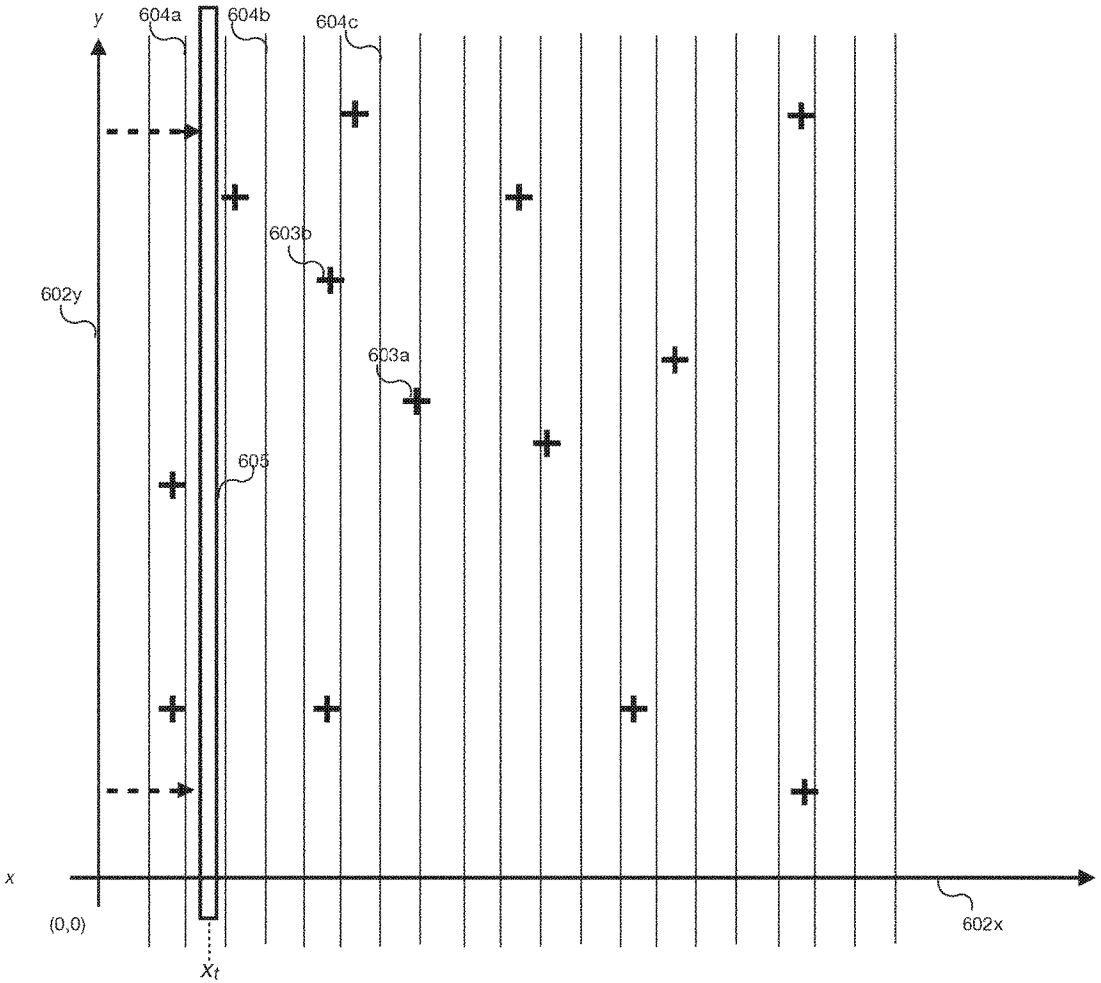
FIG. 6 is a graph illustrating quantization of the moveable nodes, in accordance with an embodiment of this disclosure.

Referring to FIG. 6, according to some embodiments of the disclosure, quantization may be used to "snap" the coordinate points to a metric, musically-relative distance grid defined by x-axis 602*x* and y-axis 602*y*. The active area may be divided into a plurality of bins 604*a*, 604*b*, 604*c*, etc. (604 generally), shown here as vertical columns. Each of the bins 604 represents a specific moment in a series of musical rhythmical events (e.g., quarter notes, eighth notes, etc. over one or more measures of musical time). When a moveable node 603*a*, 603*b*, etc. (603 generally) reports a coordinate along the x-axis 602*x* that falls within a given bin 604, the system may adjust the triggered musical event to occur at precisely the beginning of that bin. In this way, snapping the event to a precise moment in musical time. For example, node 603*a* may report an x-coordinate value that is slightly "late" in time, meaning that the exact event will occur just after the established quantized bin the system is programmed to force the events onto. The system will recognize that node 603*a* is slightly "late" and instead of trigger its respective event at its precise coordinate values, the system will trigger its event slightly earlier, to coincide with the established preferred musical point in time. In this example, the event for node 603 may be realized at a slightly lower x-axis value (e.g., earlier in time) and will be generated at the point when the transport 605 intersects with bin 604*c*.

All references cited herein are hereby incorporated herein by reference in their entirety.

Having described certain embodiments, which serve to illustrate various concepts, structures, and techniques sought to be protected herein, it will be apparent to those of ordinary skill in the art that other embodiments incorporating these concepts, structures, and techniques may be used. Elements of different embodiments described hereinabove may be combined to form other embodiments not specifically set forth above and, further, elements described in the context of a single embodiment may be provided separately or in any suitable sub-combination. Accordingly, it is submitted that the scope of protection sought herein should not be limited to the described embodiments but rather should be limited only by the spirit and scope of the following claims.

What is claimed is:

1. A method comprising:

receiving, from each of a plurality of moveable nodes, the position of the moveable node within a coordinate space, wherein the moveable nodes comprise objects that can be physically moved by a person;

generating a graph of the moveable nodes based on the received positions;

generating an audio-visual composition based on a sweep of the graph over time; and outputting the audio-visual composition.

2. The method of claim 1 wherein generating the audio-visual composition comprises generating a digital music composition.

3. The method of claim 2 wherein generating the audio-visual composition comprises generating light at each of the moveable nodes, wherein the generated light is synchronized to the digital music composition.

4. The method of claim 1 where generating the audio-visual composition based on a sweep of the graph over time comprises:

sweeping a line across the graph;

detecting when the line intersects with points on the graph corresponding to the moveable nodes;

generating musical events in response to detecting the intersects.

5. The method of claim 4 where generating the audio-visual composition based on a sweep of the graph over time comprises sweeping two or more lines across the graph simultaneously to generate musical events.

6. The method of claim 1 wherein generating the audio-visual composition based on a sweep of the graph over time comprises:

dividing the coordinate space into a plurality of bins; and assigning, to each of the moveable nodes, a bin selected from the plurality of bins using a quantization process based on the received positions.

7. A system comprising:

a processor;

at least one non-transitory computer-readable memory communicatively coupled to the processor; and processing instructions for a computer program, the processing instructions encoded in the computer-readable memory, the processing instructions, when executed by the processor, operable to perform operations comprising:

receiving, from each of a plurality of moveable nodes, the position of the moveable node within a coordinate space, wherein the moveable nodes comprise objects that can be physically moved by a person;

generating a graph of the moveable nodes based on the received positions;

generating an audio-visual composition based on a sweep of the graph over time; and outputting the audio-visual composition.

8. The system of claim 7 wherein generating the audio-visual composition comprises generating a digital music composition.

9. The system of claim 8 wherein generating the audio-visual composition comprises generating light at each of the moveable nodes, wherein the generated light is synchronized to the digital music composition.

10. The system of claim 8 where generating the audio-visual composition based on a sweep of the graph over time comprises:

sweeping a line across the graph;

detecting when the line intersects with points on the graph corresponding to the moveable nodes;

generating musical events in response to detecting the intersects.

11. The system of claim 10 where generating the audio-visual composition based on a sweep of the graph over time comprises sweeping two or more lines across the graph simultaneously to generate musical events.

12. The system of claim 10 where generating the audio-visual composition based on a sweep of the graph over time comprises:

dividing the coordinate space into a plurality of bins; and assigning, to each of the moveable nodes, a bin selected from the plurality of bins using a quantization process based on the received positions.

* * * * *